US006695644B2

(12) United States Patent
Zhao et al.

(10) Patent No.: US 6,695,644 B2
(45) Date of Patent: Feb. 24, 2004

(54) POWER CONNECTOR HAVING IMPROVED CONTACT

(75) Inventors: Qijun Zhao, Kunshan (CN); JinKui Hu, Kunshan (CN); ZiQiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/285,986

(22) Filed: Nov. 1, 2002

(65) Prior Publication Data

US 2003/0203658 A1 Oct. 30, 2003

Related U.S. Application Data

(63) Continuation-in-part of application No. 10/144,157, filed on May 10, 2002, now Pat. No. 6,623,277.

(30) Foreign Application Priority Data

Apr. 30, 2002 (TW) ..... 91205973 U

(51) Int. Cl.[7] ..... H01R 9/05
(52) U.S. Cl. ..... 439/580; 439/80
(58) Field of Search ..... 439/580, 63, 80

(56) References Cited

U.S. PATENT DOCUMENTS

| | | | | | |
|---|---|---|---|---|---|
| 4,255,011 | A | * | 3/1981 | Davis et al. | 439/580 |
| 4,307,926 | A | * | 12/1981 | Smith | 439/580 |
| 4,702,707 | A | * | 10/1987 | Hillbish | 439/80 |
| 5,376,012 | A | * | 12/1994 | Clark | 439/80 |
| 5,547,400 | A | * | 8/1996 | Wright | 439/63 |
| 5,676,565 | A | * | 10/1997 | Vagnoni | 439/580 |
| 5,759,069 | A | * | 6/1998 | Kitatani et al. | 439/580 |
| 6,042,394 | A | * | 3/2000 | Mitra et al. | 439/80 |
| 6,190,215 | B1 | * | 2/2001 | Pendleton et al. | 439/80 |

* cited by examiner

*Primary Examiner*—Gary Paumen
(74) *Attorney, Agent, or Firm*—Wei Te Chung

(57) ABSTRACT

A power connector (1) includes an insulative housing (2), a first conductive contact (5) and a second conductive contact (6). The insulative housing includes a receiving space (3) defined inwardly from a front surface of the housing and an inner portion (22) bounded on its sides by the receiving space. Each contact includes a main body (51, 61) assembled in the rear wall of the housing and a plurality of mating portions (53, 63). The mating portions are assembled in the housing and partly exposed in the receiving space. The mating portions of the first conductive contact are arranged on an outer circle. The mating portions of the second conductive contact are arranged on an inner circle inside the outer circle.

20 Claims, 11 Drawing Sheets

5

POWER CONNECTOR HAVING IMPROVED CONTACT

CROSS-REFERENCE TO RELATED APPLICATION

This patent application is a continuation-in-part (C-I-P) application of U.S. patent application Ser. No. 10/144,157, filed on May 10, 2002, now U.S. Pat. No. 6,623,277 invented by ZiQiang Zhu, Jinkiu Hu and Qijun Zhao, entitled "POWER CONNECTOR" and all assigned to the same assignee of this patent application.

BACKGROUND OF THE INVENTION

1. Field of the Invention

The present invention relates to a power connector, and particularly to a power receptacle connector having improved contacts for reliably and stably engaging with a power plug connector.

2. Description of Related Art

Power connectors are widely used in electronic devices to transmit electrical power to the devices. Such power connectors are disclosed in Taiwan pat. No. 449,135, and U.S. Pat. Nos. 4,702,707, 5,376,012 and 6,190,215. Please refer to FIG. 10 and FIG. 11, Taiwan Pat. No. 449,135 discloses a power connector 9 which mates with a complementary connector 97 having two columnar contacts 95 and 96, acting as a positive contact and a negative contact respectively. The power connector 9 includes a dielectric housing 90, a U-shaped stationary switch contact 92 locating at a rear end of the housing 90, a moveable switch contact 93 extending along a lateral side of the housing 90, a conductive pin 91 longitudinally accommodated in the housing 90, and a metal spring member 94 secured at an underside of the housing 90. The inner contact 96 of the complementary connector 97 locates in a core of the outer contact 95. An outer surface of the conductive pin 91 of the power connector 9 contacts an inner mating surface of the inner contact 96. If the contact between the conductive pin 91 and the inner contact 96 is too loose, a reliable power transmission cannot be assured. If the contact between the conductive pin 91 and the inner contact 96 is too tight, the pin 91 and contact 96 are easily damaged after repeated mating/unmating of the connectors 9, 97. The moveable switch contact 93 and the metal spring member 94 contact the outer contact 95 in mutually perpendicular directions, whereby a force is acting on the outer contact 95, which may result a deviation of the outer contact 95 from its original position. When this happens, a reliable power transmission between the connectors 9, 97 can no longer be obtained.

U.S. Pat. No. 6,190,215 discloses a contact which mates with a male pin contact of any desired length. Mating portions of the contact are beam-shaped and are integrally stamped with soldering portions from a metal blank. The contact disclosed in U.S. Pat. No. 6,190,215 can resolve the problem caused by the removable switch contact 93 and the metal spring member 94 of the connector of Taiwan Pat. No. 449,135. However, the shortage of the contact between the conductive pin 91 and the columnar inner contact 96 is still not improved.

Hence, a power connector having improved contacts is desired to overcome the disadvantages of the prior art.

SUMMARY OF THE INVENTION

Accordingly, an object of the present invention is to provide a power receptacle connector having improved contacts for reliably and stably engaging with a power plug connector.

A power connector comprises an insulative housing, a first conductive contac and a second conductive contact. The insulative housing includes a receiving space defined rearwardly from a front surface of the insulative housing and an inner portion extending from a rear wall of the housing and bounded on its the receiving space. Each of the first and second contacts comprises a main body assembled in the rear wall of the housing, and a plurality of mating portions integrally formed with the main body adapted for engaging with a contact of a mating connector. The mating portions are assembled in the housing and are partly exposed in the receiving space. The mating portions of the first conductive contac are arranged on an outer circle, and the mating portions of the second conductive contact are arranged on an inner circle inside the outer circle.

Other objects, advantages and novel features of the invention will become more apparent from the following detailed description when taken in conjuction with the accompanying drawings.

DETAILED DESCRIPTION OF THE INVENTION

Figure 1:
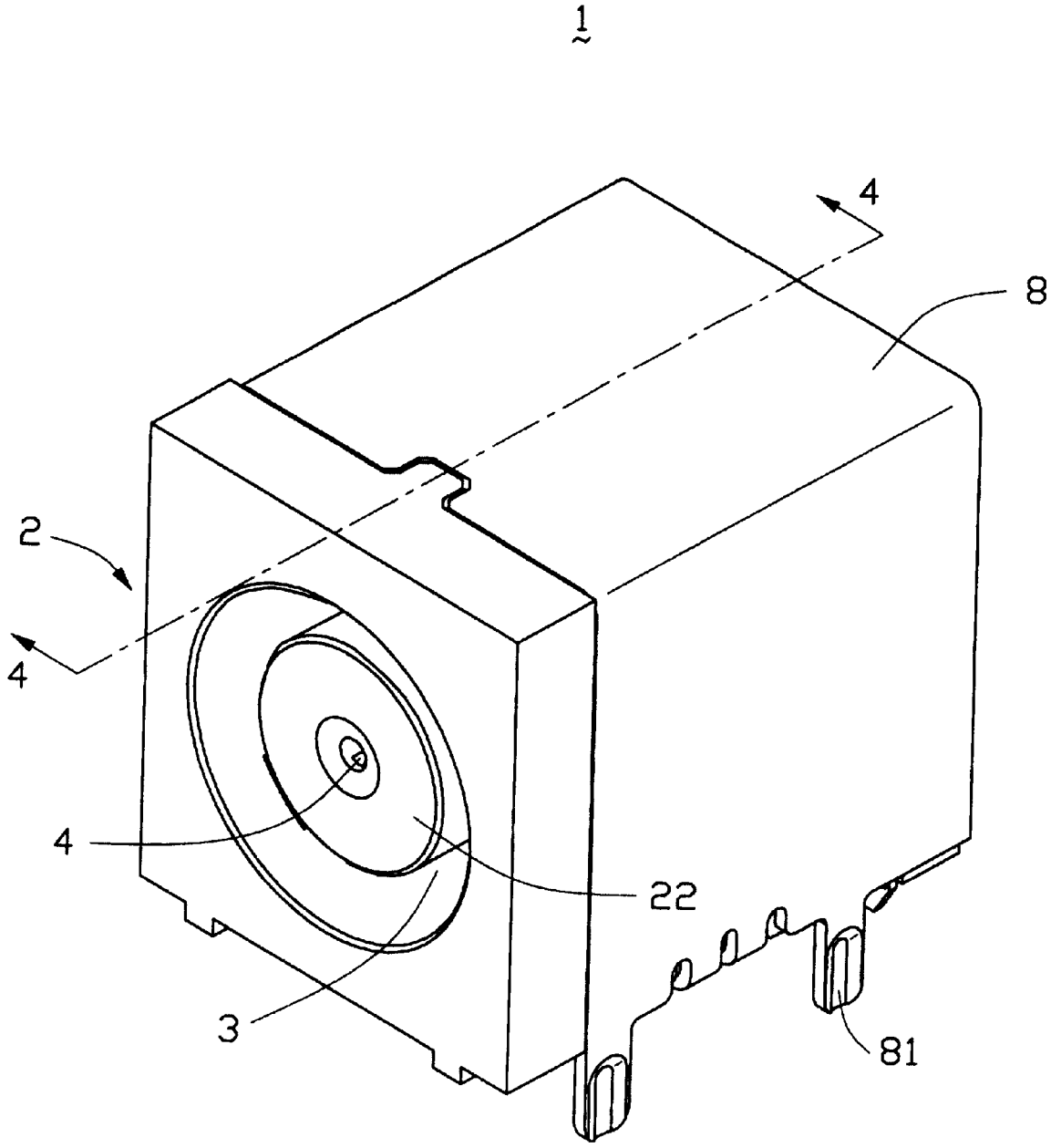
FIG. 1 is a perspective, assembled view of a power connector in accordance with the present invention.

Referring to FIGS. 1 to 4, a power connector 1 of the present invention comprises an insulative housing 2, a first conductive contact 5, a second conductive contact 6, a conductive pin 7 and a conductive shield 8.

The insulative housing 2 is in the shape of a rectangular block. A rectangular key 211 is formed on a front portion (not labeled) of a top wall (not labeled) of the housing 2. An annular receiving space 3 is defined rearwardly from a front face (not labeled) of the housing, creating a cylindrical inner portion 22 of the housing 2, which extends forwardly from a rear wall (not labeled) of the housing 2 and is bounded on its sides by the receiving space 3. A receiving hole 4 is defined along a longitudinal axis of the inner portion 22. An annular first receiving slot 23 is defined in a periphery of the rear wall of the housing 2. A second receiving slot 24 is defined in a core of the rear wall of the housing 2 and has a rectangular shape. Four first holes 231 in communication with the first receiving slot 23 are defined in four corners (not labeled) of the housing 2, extending forwardly from the rear wall of the housing 2 toward the front surface of the housing 2 and communicating at their forward ends with the receiving space 3. Four second holes 241 in communication both with the second receiving slot 24 and the receiving space 3 are defined in the rear wall of the housing 2, extending forwardly through the rear wall and generally parallel to the top, a bottom, and two side walls of the housing 2. Corresponding to the orientation of the four first holes 231, four first grooves 232 in communication with the first receiving slot 23 are defined in an inner surface (not labeled) of the housing 2, and extend forwardly from the rear wall of the housing 2. Corresponding to the orientation of the second holes 241, four second grooves 242 are defined in an outward surface (not labeled) of the inner portion 22, and extend forwardly from the rear wall of the housing 2 and in communication with the second receiving slot 24. A center slot 25 coincident with the receiving hole 4 is defined through the rear wall and into the inner portion 22.

Figure 5:
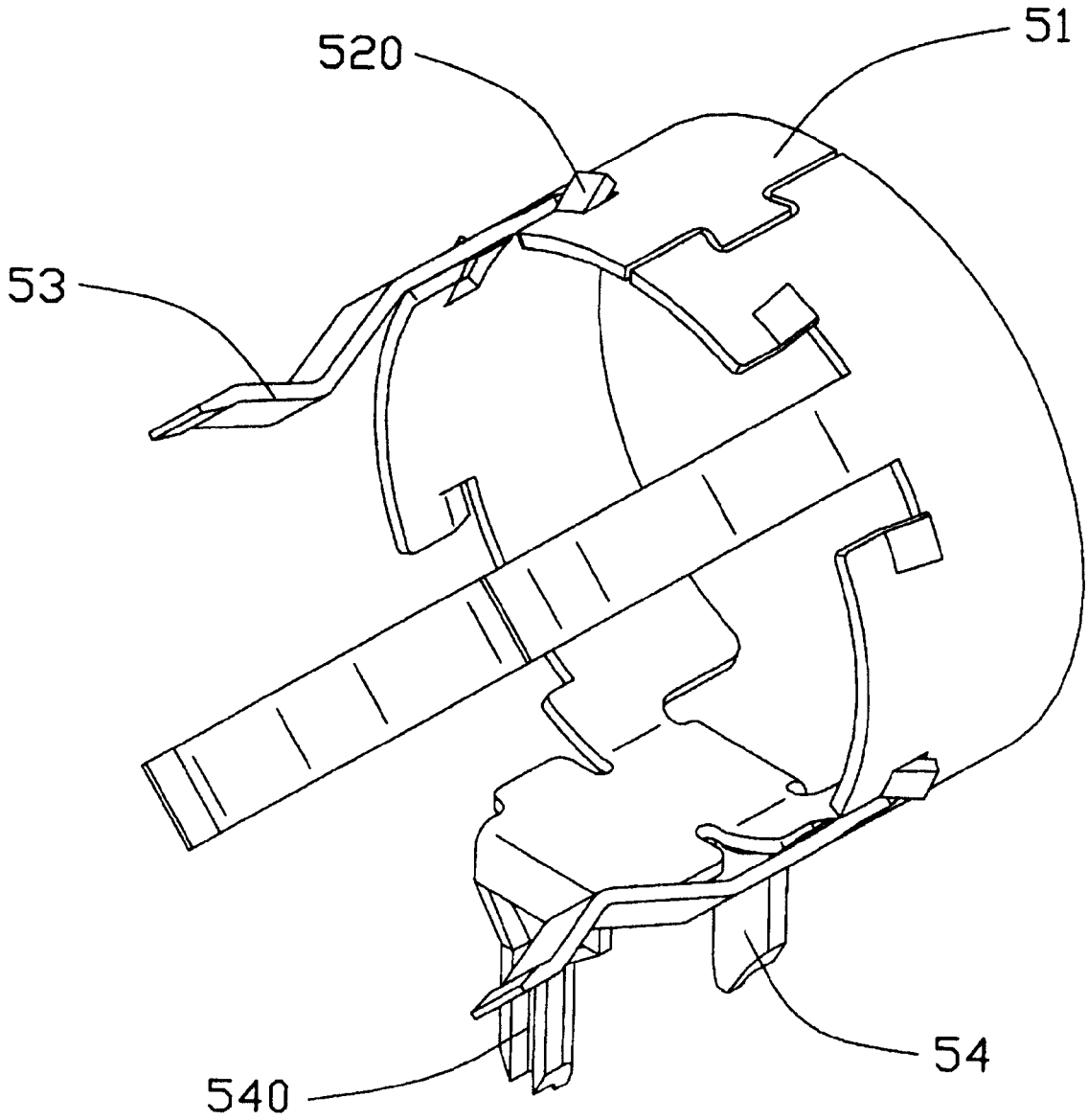
FIG. 5 is a perspective view of a first conductive contact of the power connector of the present invention.
Figure 6:
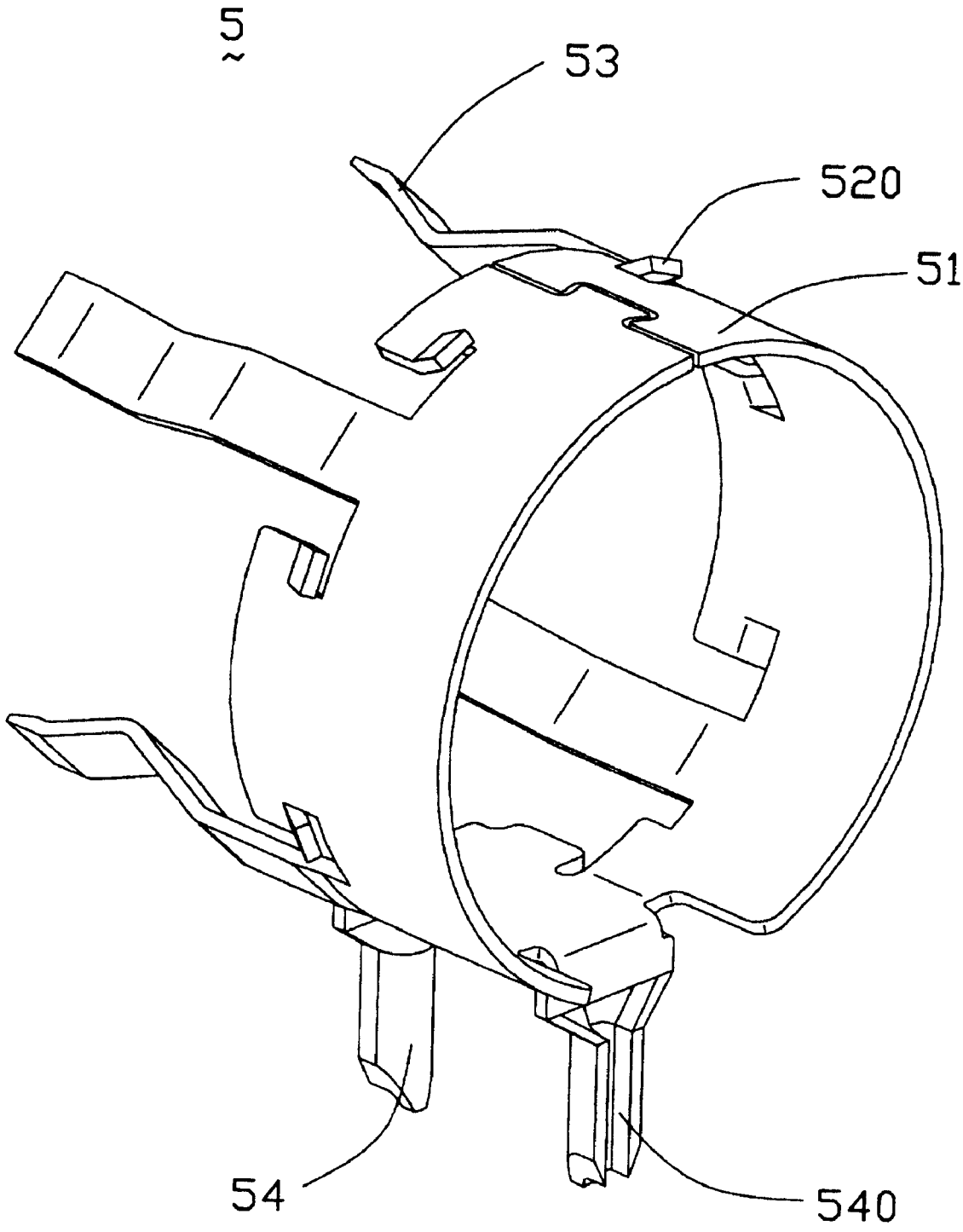
FIG. 6 is a view similar to FIG. 5, from a rear aspect.

Referring to FIGS. 5 and 6, The first conductive contact 5 comprises an annular main body 51, four mating portions 53 and a pair of feet 54. Each mating portion 53 extends forwardly from a front edge of the main body 51. The mating portions 53 are arranged in equal intervals. A plurality of tabs 520 is formed on the main body 51 and is bent outwardly from the main body 51. The pair of feet 54 for solder connection to a printed circuit board (not shown) extends downwardly from a bottom front edge and a bottom rear edge of the main body 51, correspondingly. Each foot 54 defines a short slot 540 therein for receiving molten solder during soldering the feet 54 to the PCB.

Figure 7:
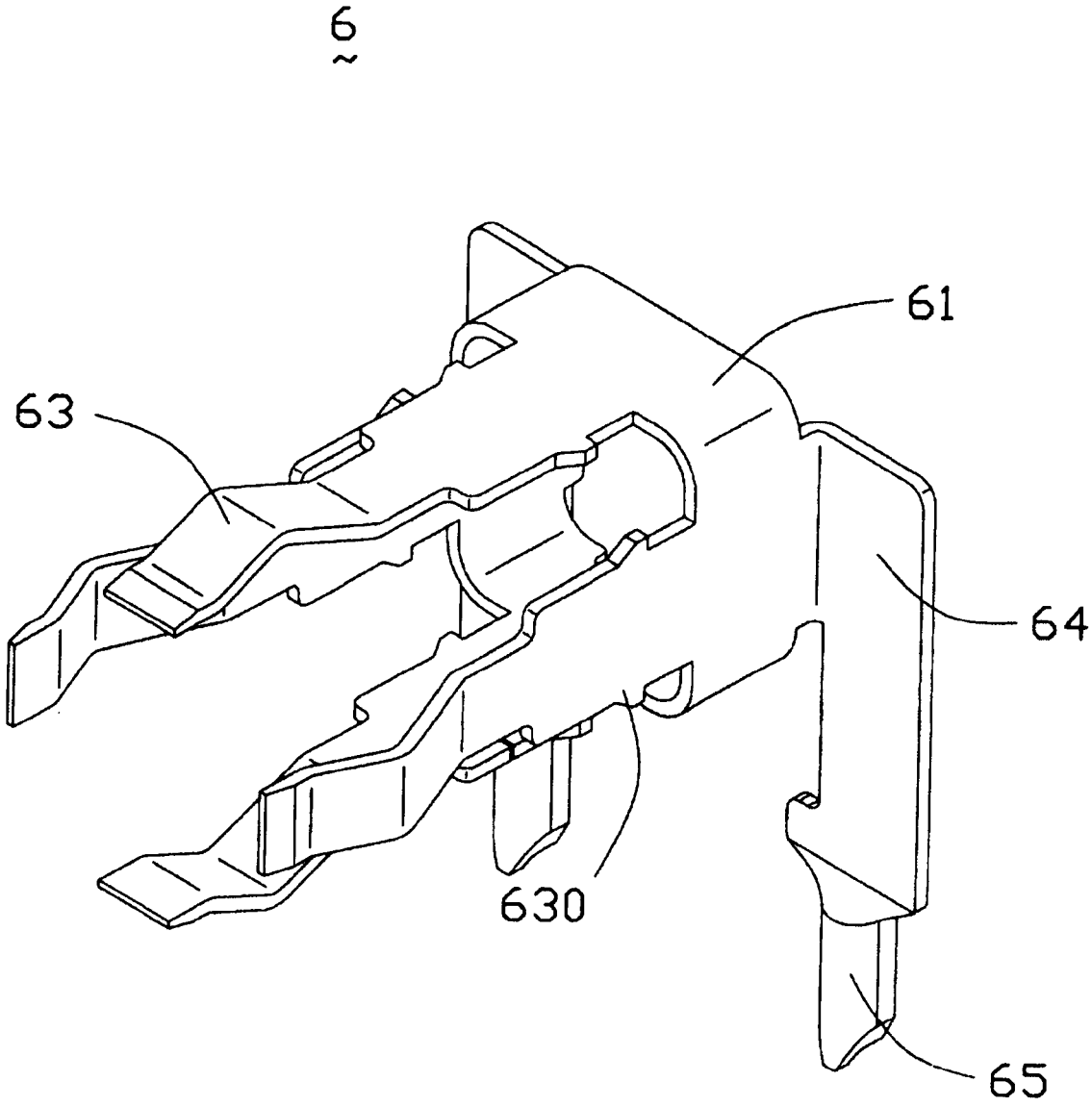
FIG. 7 is a perspective view of a second conductive contact of the power connector of the present invention.
Figure 8:
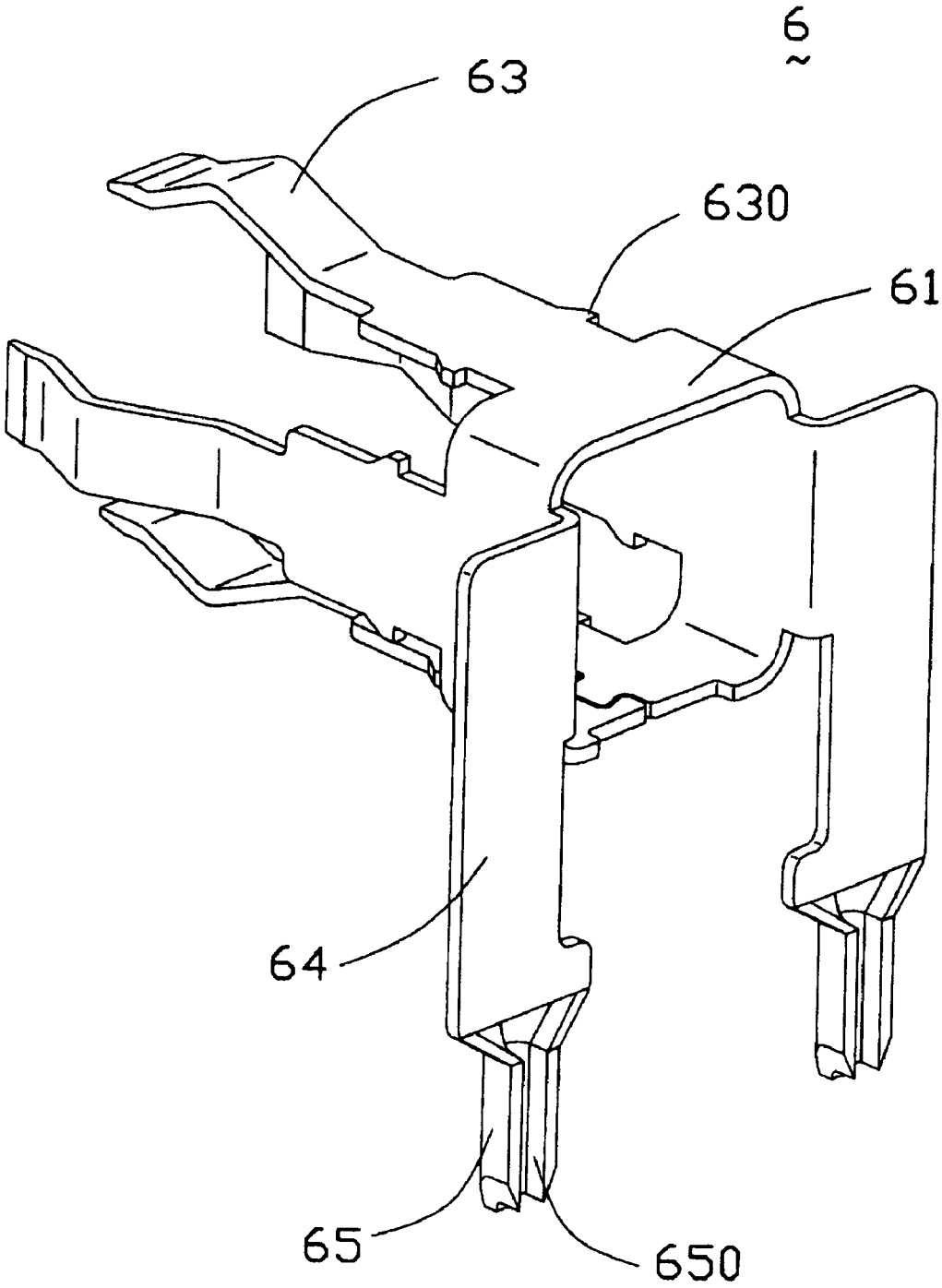
FIG. 8 is a view similar to FIG. 7, from a rear aspect.
Figure 9:
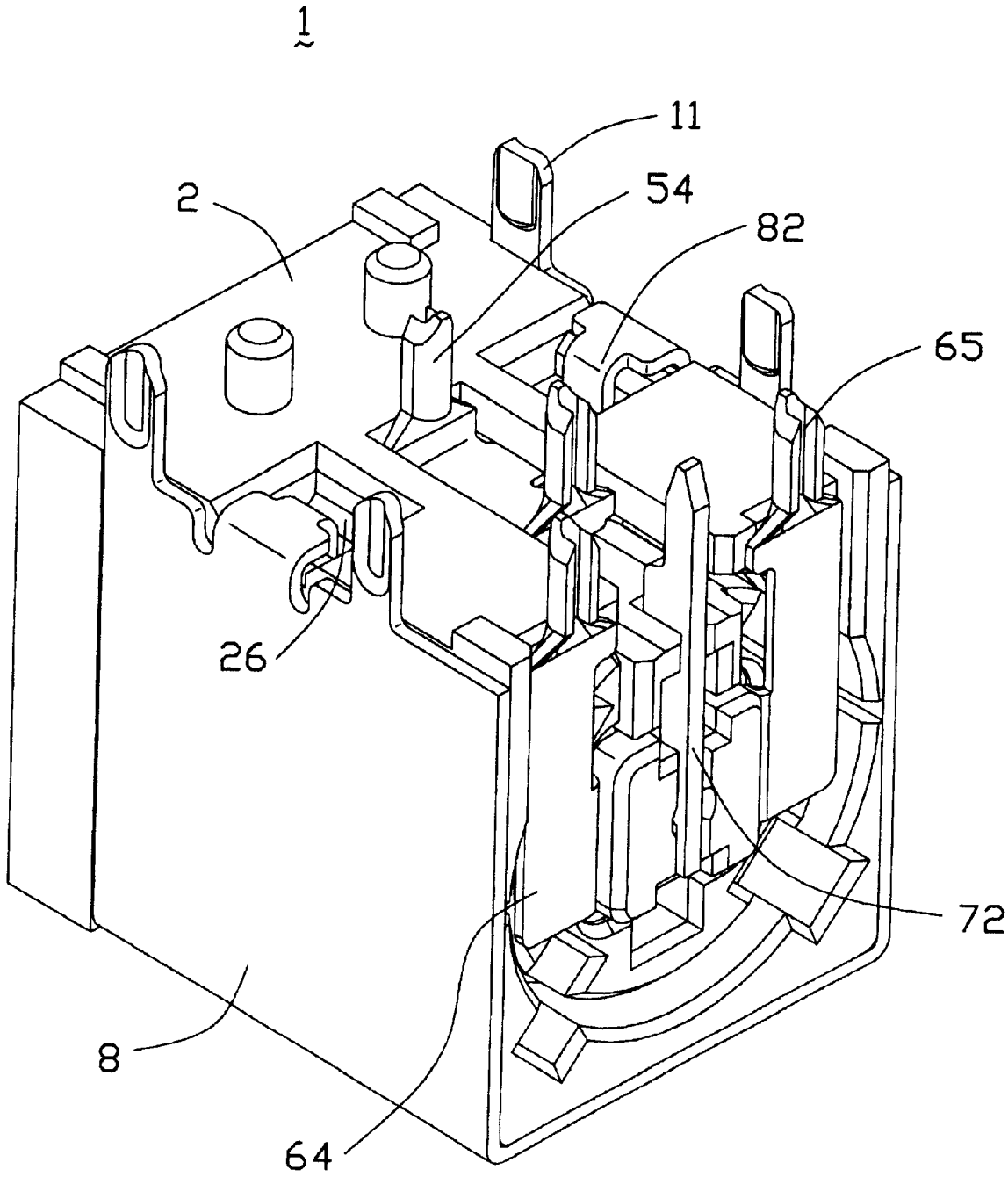
FIG. 9 is a view similar to FIG. 1, from a bottom, rear aspect.
Figure 10:
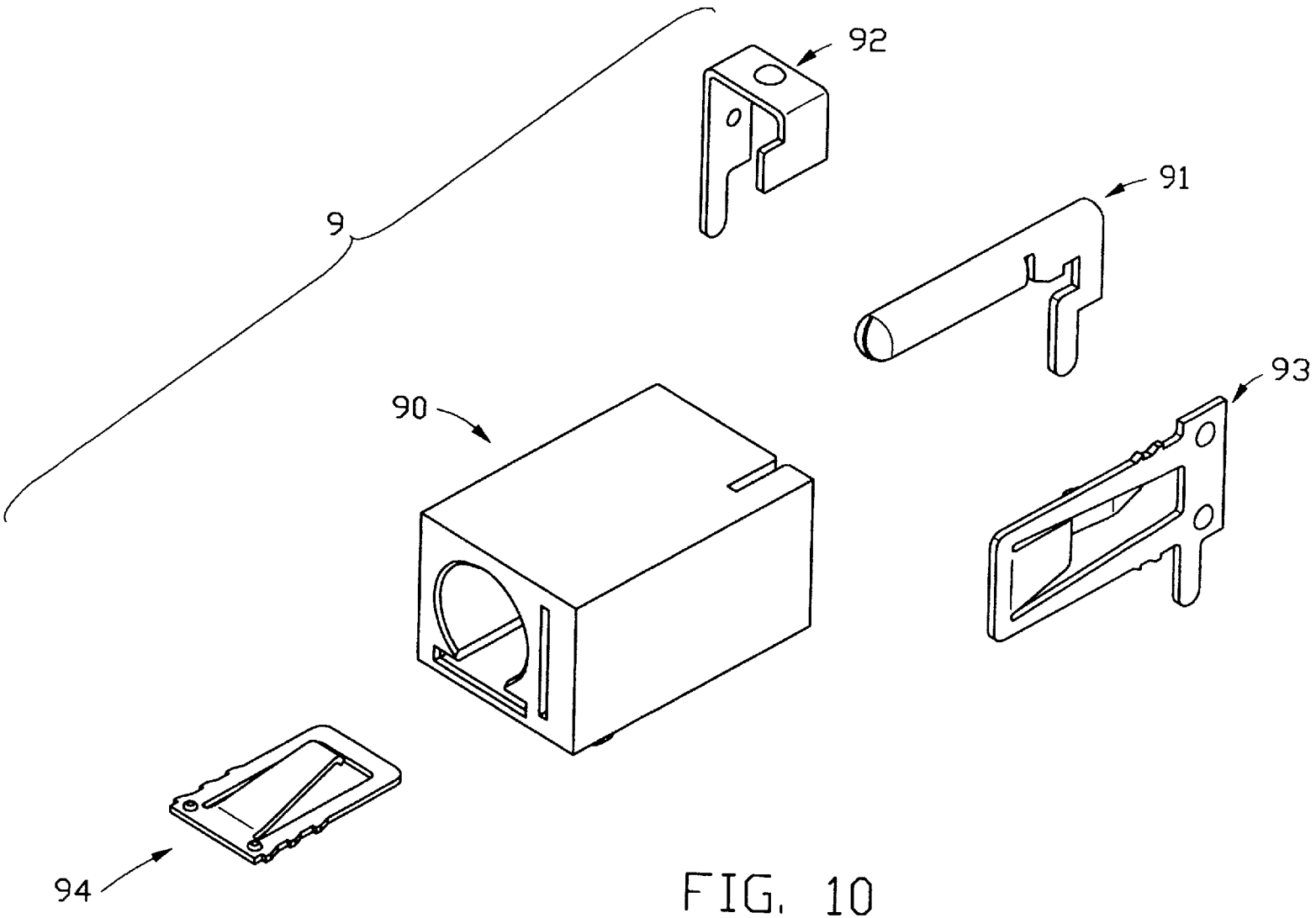
FIG. 10 (PRIOR ART)
FIG. 10 is an exploded view of a conventional power connector.
Figure 11:
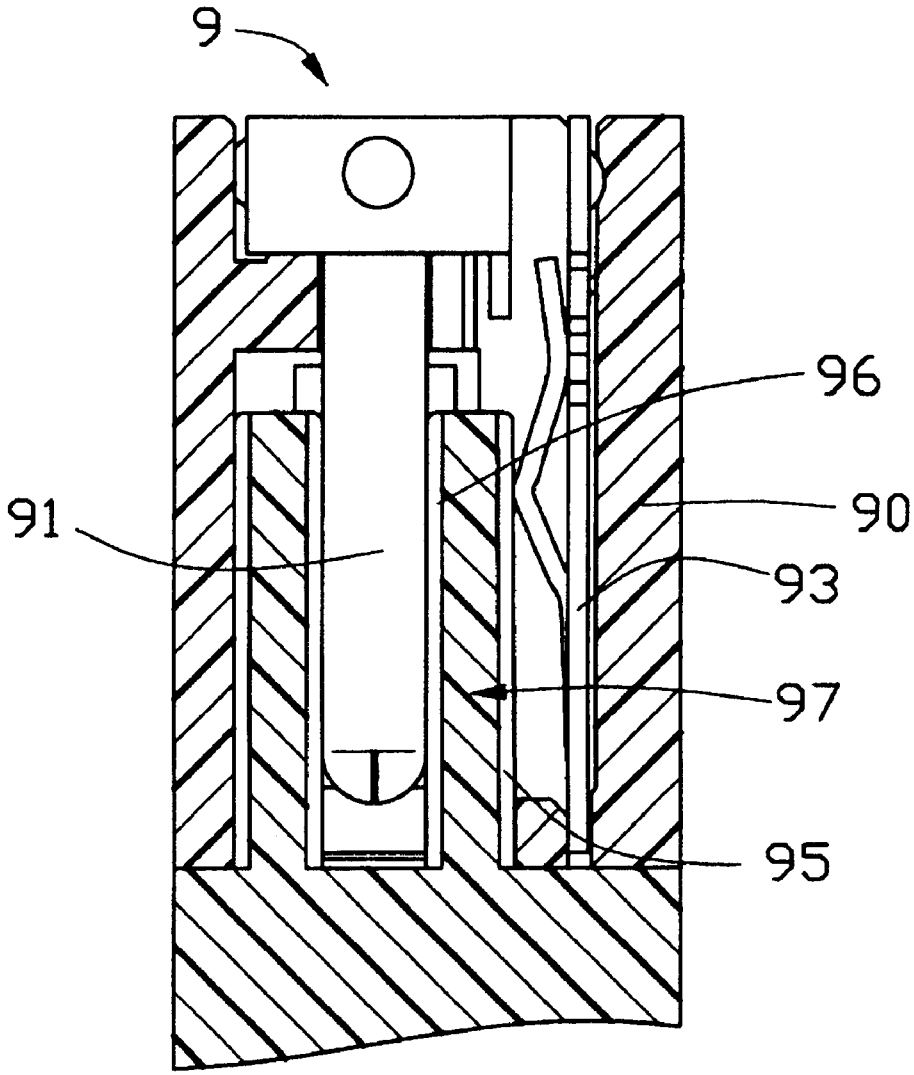
FIG. 11 (PRIOR ART)
FIG. 11 is a cross sectional view of the conventional power connector of FIG. 10 mating with a complementary power connector.

Referring to FIGS. 7 and 8, the second conductive contact 6 comprises a rectangular main body 61, four mating portions 63 with barbs 630 formed on a pair of edges (not labeled) of a rear portion thereof, and a pair of legs 64. The mating portions 63 extend forwardly from a top, a bottom, a left side and a right side of the main body 61. The mating portions 63 are arranged in equal intervals. The pair of legs 64 extends downwardly from the opposite right and left sides of the main body 61. A pair of feet 65 for solder connection to the printed circuit board extends downwardly from the lower ends of the pair of legs 64, and each defining a short slot 650 therein for receiving molten solder during soldering the feet 65 to the PCB.

Figure 2:
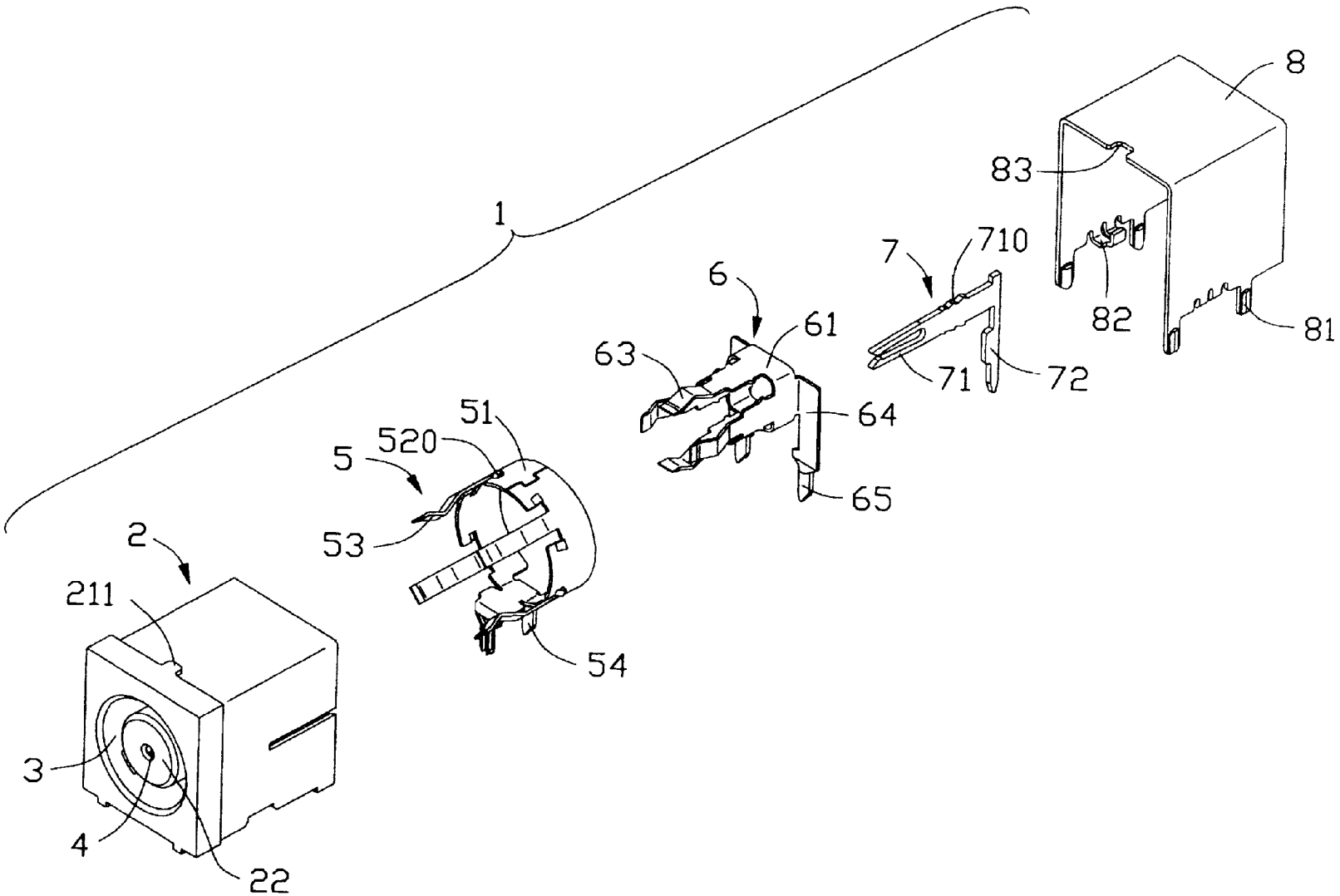
FIG. 2 is an exploded view of the power connector of FIG. 1.
Figure 3:
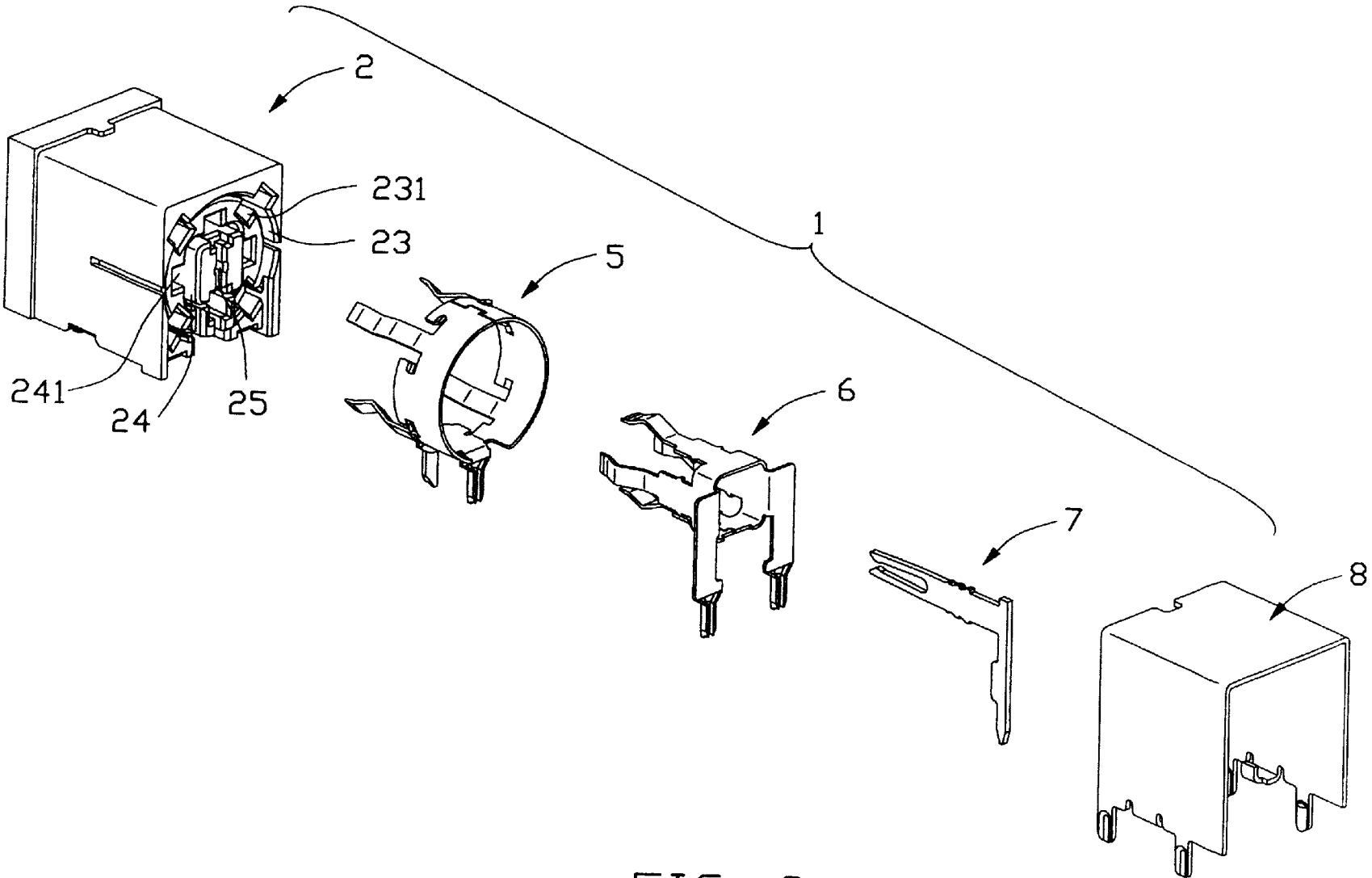
FIG. 3 is a view similar to FIG. 2, from a rear aspect.
Figure 4:
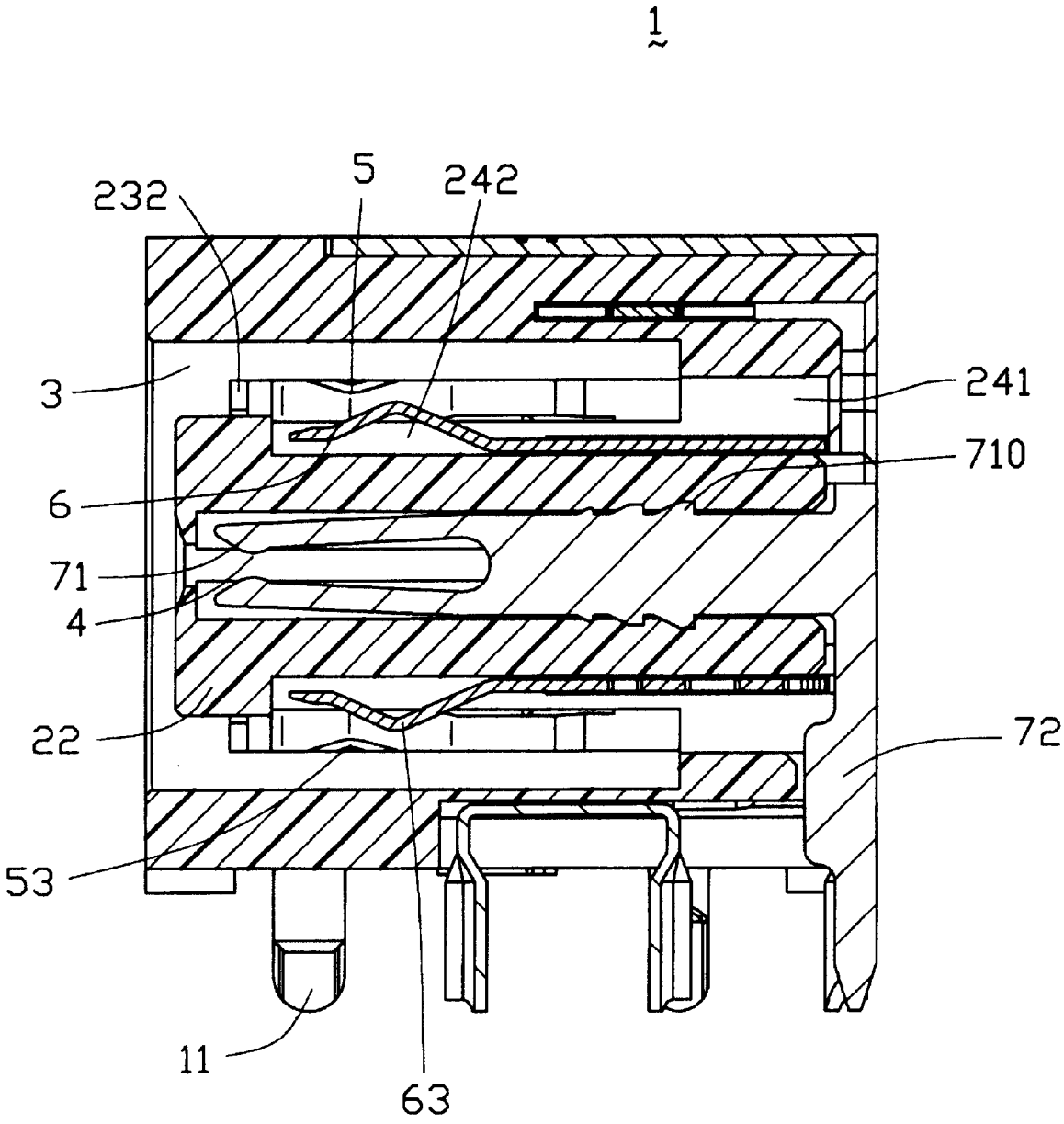
FIG. 4 is a cross sectional view of the power connector taken along line 4—4 of FIG. 1.

Referring to FIG. 2, the conductive pin 7 comprises a mating portion 71 having a tuning-fork shape and a mounting portion 72 extending downwardly from a rear end of the mating portion 71. A plurality of barbs 710 is formed on upper and lower edges of the mating portion 71.

The conductive shield 8 has the shape of an inverted "U" and defines a cutout 83 at a front of a top wall (not labeled) thereof. A pair of soldering feet 81 extends downwardly from a lower edge (not labeled) of each of two opposite side walls (not labeled). A locking tab 82 extends inwardly and upwardly from the lower edge of each sidewall of the conductive shield 8.

The first conductive contact 5 acts as a positive contact, while the second conductive contact 6 acts as a negative contact for the connector 1. Now referring to FIGS. 3 to 9, in assembly, the first conductive contact 5 is assembled in the insulative housing 2 from the rear thereof. The main body 51 is received in the first receiving slot 23 of the housing 2 with the tabs 520 engaging the first receiving slot 23 for securely fixing the main body 51 to the housing 2. The mating portions 53 protrude through the first holes 231 and are received in the first grooves 232 defined on the inner surface of the housing 2. The mating portions 53 bend inwardly and partly protrude from the first grooves 232 into the receiving space 3 for mating with the mating connector (not shown). The pair of feet 54 is mounted to the printed circuit board (not shown). The second conductive contact 6 is assembled in the insulative housing 2 from the rear thereof. The main body 61 is received in the second receiving slot 24 of the housing 2. The mating portions 63 protrude through the second holes 241 and are received and securely fixed in the second grooves 242 defined in the outer surface of the inner portion 22, in which the barbs 630 bite into the inner portion 22. The mating portions 63 bend outwardly and partly protrude from the second grooves 242 into the receiving space 3 for mating with the mating connector. The pair of legs 64 covers part of the rear wall of the housing 2 and the pair of feet 65 is mounted to the printed circuit board.

The conductive pin 7 is inserted into the insulative housing 2 from the rear end thereof. The mating portion 71 is received in the receiving hole 4 and the barbs 710 formed thereon have an interferential engagement in the receiving hole 4. The mounting portion 72 is received into the center slot 25 communicating with the receiving hole 4 for being mounted to the printed circuit board. The conductive shield 8 encloses the insulative housing 2 and the pair of locking tabs 82 locks into slots 26 in the bottom wall of the housing 2 (shown in FIG. 9). The cutout 83 of the conductive shield 8 engages with the key 211 of the housing 2.

In the present invention, the four mating portions 53 of the first conductive contact 5 lie on an outer circle, while the four mating portions 63 of the second conductive contact 6 lie on an inner circle inside the outer circle. Therefore, when the mating connector mates with the power connector 1, the resilient mating portions 53, 63 of the first and second conductive contacts 5, 6 engage respectively with tubular positive and negative contacts of the mating connector. The mating portions 53, 63 exert engaging forces in opposite directions to the tubular contacts of the mating connector; the forces counteract each other, whereby the tubular positive and negative contacts of the mating connector will not be deflected due to engagement of the mating connector with the connector 1 in accordance with the present invention. Even the direction of the mating connector inserted into the receiving space 3 of the power connector 1 is deviated, the two-layer design of the resilient contacts 5, 6 can correct the inserted direction for assuring stable transmission of power.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector for being mounted to a printed circuit board, comprising:

an insulative housing including a receiving space defined rearwardly from a front surface of the insulative housing and an inner portion extending from a rear wall of the housing and bounded on its sides by the receiving space;

a first conductive contact and a second conductive contact, each of the first and second contacts comprising a main body assembled in the rear wall of the housing and a plurality of mating portions integrally formed with the main body adapted for engaging with a contact of a mating connector, the mating portions assembled in the housing and partly exposed in the receiving space, the mating portions of the first conductive contact arranged on an outer circle and the mating portions of the second conductive contact arranged on an inner circle inside the outer circle.

2. The power connector as described in claim 1, wherein a first receiving slot is defined in the rear wall of the housing, and the main body of the first conductive contact is received in the first receiving slot, a second receiving slot is also defined in the rear wall of the housing, and the rectangular main body of the second conductive contact is received in the second receiving slot.

3. The power connector as described in claim 2, wherein the first receiving slot is annular, and the second receiving slot is rectangular.

4. The power connector as described in claim 3, wherein the first receiving slot locates in a periphery of the rear wall of the housing, and the second receiving slot locates in a core of the rear wall of the housing.

5. The power connector as described in claim 2, wherein four first holes are defined in the rear wall of the housing and in communication with the first receiving slot, the first holes extend forwardly from the rear wall of the housing toward the front surface of the housing.

6. The power connector as described in claim 5, wherein four first grooves in communication with the first receiving slot are defined in an inner surface of the housing, and extend forwardly from the rear wall of the housing, and the four mating portions of the first conductive contact extend through the first holes and are received in the first grooves.

7. The power connector as described in claim 6, wherein the mating portions of the first conductive contact extend forwardly from the main body and are arranged in equal intervals.

8. The power connector as described in claim 7, wherein each mating portion of the first conductive contact bends inwardly and partly protrudes from a corresponding first groove into the receiving space.

9. The power connector as described in claim 7, wherein four second holes in communication both with the second receiving slot and the receiving space are defined in the rear wall of the housing, and extend forwardly through the rear wall and generally parallel to a top, a bottom and two side walls of the housing.

10. The power connector as described in claim 9, wherein corresponding to the orientations of the second holes, four second grooves in communication with the second receiving slot are defined in an outer surface of the inner portion, and extend forwardly from the rear wall of the housing, and the mating portions of the second conductive contact protrude through the second holes and received in the second grooves, the second conductive contact having barbs engaging with the inner portion.

11. The power connector as described in claim 10, wherein each mating portion of the second conductive contact bends outwardly and partly protrudes from the second grooves into the receiving space.

12. The power connector as described in claim 11, wherein the mating portions of the second conductive contact extends forwardly from a top, a bottom, a left side and a right side of the main body thereof, respectively, and are arranged in equal intervals.

13. The power connector as described in claim 1, wherein the first conductive contact further includes a pair of feet for solder connection to the printed circuit board, extending downwardly from a bottom front edge and a bottom rear edge of the main body of the first conductive contact, each foot defining a short slot therein.

14. The power connector as described in claim 1, wherein the second conductive contact further includes a pair of legs extending downwardly from opposite sides of the main body thereof, and a pair of feet extending downwardly from lower ends of the pair of legs for solder connection to the printed circuit board and each foot of the second conductive contact defining a short slot therein.

15. The power connector as described in claim 1, wherein a receiving hole is defined along a longitudinal axis of the inner portion and communicates with a central slot defined through the rear wall and into the inner portion of the insulative housing.

16. The power connector as described in claim 15, wherein the power connector further comprises a conductive signal pin comprising a mating portion received in the receiving hole, a mounting portion extending downwardly from the mating portion and received in the central slot for being mounted to the printed circuit board.

17. The power connector as described in claim 1, wherein the conductive shield further comprises a pair of lock tabs extending inwardly and upwardly from a lower edge of each of two sidewalls thereof, the lick tabs respectively locking into slots in a bottom wall of the housing.

18. An electrical connector for use with a complementary connector, comprising:

an insulative housing defining thereof opposite front and rear faces with an inner central receiving portion and an outer circumferential receiving space;

a center contact located in the inner central receiving portion; and an outer contact assembly located in the outer circumferential receiving space; wherein said outer contact assembly defines two groups of mating fingers, of which one is arranged in an inner circle and the other is arranged in an outer circle, said inner circle and said outer circle together defining a gap adapted for receiving a sleeve-like contact of said complementary connector therein.

19. The connector as described in claim 18, wherein said two groups of mating fingers are alternately located circumferentially.

20. The connector as described in claim 18, wherein said two groups of mating fingers belong to two discrete pieces.

* * * * *